US006073416A

United States Patent [19]

Peter

[11] Patent Number: 6,073,416

[45] **Date of Patent: *Jun. 13, 2000**

[54] CAP FOR PROTECTING WOOD CONSTRUCTION MEMBER SUPPORTED BY ELEVATED BASE

[75] Inventor: Henry Peter, West Springfield, Mass.

[73] Assignee: Robert L. Consolini, Canaan, Conn.

[ * ] Notice: This patent is subject to a terminal disclaimer.

[21] Appl. No.: 09/412,915

[22] Filed: Oct. 5, 1999

[51] Int. Cl.[7] ..... E04C 3/30

[52] U.S. Cl. ..... 52/736.4; 52/737.5; 52/298; 248/519

[58] Field of Search ..... 52/170, 296, 298, 52/720.2, 736.3, 736.4, 737.3, 738.1, 741.3, 737.4

[56] References Cited

U.S. PATENT DOCUMENTS 4,972,642 11/1990 Strobl, Jr. .
5,090,165 2/1992 Kenny .
5,901,525 5/1999 Doeringer et al. .

*Primary Examiner*—Carl D. Friedman
*Assistant Examiner*—Kevin McDermott
*Attorney, Agent, or Firm*—Edward Gray

[57] ABSTRACT

A cap for protecting from rot and other deterioration the lowermost portion of a wood construction member supported by an elevated base. The cap has four lateral faces and a top face with a rectangular aperture formed by four flexible web portions which press against the member. The dimensions of the lateral faces are selected so that the lateral face bottom edges have a desired above-ground clearance.

9 Claims, 2 Drawing Sheets

CAP FOR PROTECTING WOOD CONSTRUCTION MEMBER SUPPORTED BY ELEVATED BASE

BACKGROUND OF THE INVENTION

1. Field of the Invention

The present invention relates to building construction supports, and more particularly to a cap enclosing an elevated base which supports a wood column or post, thus protecting the wood lowermost portion from rot and other deterioration due to exposure to moisture, heat, fungus and parasites.

2. Description of the Related Art

Wood has been a traditional material in the world's tropic and two temperate zones, especially where lumber is an indigenous product which is easily available locally. But in tropical regions such as Central and South America, Africa, and Southeast Asia, wooden structures are susceptible to deterioration from the effects of humidity, heat and ultraviolet radiation. Usually the lowermost portion (i.e., the base portion) of vertical wood columns which support a building is the most vulnerable structural element because it is most exposed to moisture. In buildings having side walls as in the temperate zones, water accumulates through seepage; in buildings on stilts as in the tropics, support column base portions are directly exposed repeatedly as rain water accumulates and evaporates. Therefore, the lifetime of a building depends largely upon how long its columns endure. Typically, the life of a wood column in the tropics is limited to about 20 years, with failure due to rot usually occurring where the column intersects the earth. But where rotting has been prevented, e.g., by placing a building on a solid foundation of stone, the building can last for hundreds of years.

There is an urgent need, especially in the tropics, for a method of building houses from lumber available locally which can produce houses which will last at least as long as those built using concrete. The problems in achieving such longevity are preventing the wood support column base portion from rotting, and providing a stanchion-type base to enclose and support the base portion which can withstand the high up-loads, down-loads and transverse loads to which the column would be subjected during hurricanes.

The elevated column base disclosed in U.S. Pat. No. 5,901,525, of which I am a coinventor and which is incorporated herein by reference in its entirety, provides a solution for both preventing rot and withstanding high loading. The column base includes a stanchion, a diaphragm and a cap, each monolithically molded from a thermoplastic. For regions and/or structures where high loading is not a concern, the principle taught therein of enclosing the lowermost portion of a wood column or post and its supporting elevated base to shield it from inimical environments can be applied in providing caps tailored to particular wood member and base combinations. An additional benefit provided by such enclosures is protection against impact from lawn mowers, weed whackers, and the like.

Elevated bases to raise wood columns and posts above concrete surfaces subject to wetting are widely used in the construction of buildings and ancillary structures such as decks, porches and fences. Many such bases are known in the construction arts including those disclosed in: U.S. Pat. No. 5,568,909 to R. J. Timko; U.S. Pat. No. 5,123,623 to J. F. McNamara; U.S. Pat. No. 4,995,206 to K. W. Colonias et al.; U.S. Pat. No. 4,958,470 to C. M. Han et al.; U.S. Pat. No. 4,924,648 to T. T. Gilb et al.; U.S. Pat. No. 4,644,713 to J. F. Lehman; U.S. Pat. No. 4,614,070 to K. Idland; and U.S. Pat. No. 4,199,908 to D. L. Teeters. However, none of these elevated bases include an assembly to shield the wood lowermost portion from the environment. Shielding devices have been devised, but in the context of protecting a wood member embedded into the ground. U.S. Pat. No. 5,090,165 to L. D. Kenny discloses a molded plastic sleeve which fits over the circumferential base of an embedded post or pole. The sleeve forms a barrier intended to retard the decaying or rotting of the wood. An umbrella-like rim at the top of the sleeve deflects excess moisture which may run down the member, and two vents extending from the sleeve base to several inches above the ground provide expansion areas for freezing should moisture accumulate in the sleeve. U.S. Pat. No. 4,972,642 to F. P. Strobl, Jr. provides a foot for supporting a wood post at the bottom of a hole which typically extends below the frost line. The plastic foot is monolithically molded and has a dishshaped bottom wall configured to be supported by the earth at the bottom of the hole.

OBJECTS OF THE INVENTION

In view of the limitations of the related art, it is an object of the present invention to provide a device which shields the lowermost portion of a wood construction member supported by an elevated base from inimical environments such as moisture, heat, fungus and wood parasites.

Another object of the invention is to provide a device whose configuration can be easily adapted to accommodate a wide variety of wood member and elevated base combinations.

A further object of the invention is to provide a device which is simple, reliable and inexpensive to manufacture.

SUMMARY OF THE INVENTION

These and other objects are achieved by the present invention which in a first aspect provides a cap including a number of planar lateral faces, with each pair of contiguous faces rigidly attached along a common edge. Each face has parallel top and bottom edges. The cap further includes a top face having the same number of independently flexible web portions as the number of lateral faces. Each web portion has a relatively thick outer edge rigidly attached along the top edge of a lateral face, and tapers in thickness from the outer edge to a relatively thin inner edge. The web portion inner edges determine an aperture.

In a second aspect the invention provides a cap including opposed first and second lateral faces and opposed third and fourth lateral faces orthogonal to the first and second faces. Each contiguous pair of mutually orthogonal faces is rigidly attached along a common edge, each face has generally parallel top and bottom edges, and each contiguous pair of bottom edges determines a bottom corner edge. The cap further includes a top face having four mutually orthogonal, independently flexible web portions. Each web portion has a relatively thick outer edge rigidly attached along the top edge of a lateral face, tapers in thickness from the outer edge to a relatively thin inner edge, and tapers laterally inwardly from the outer edge to the inner edge. The inner edges determine a generally rectangular aperture.

In a third aspect the invention provides a method for protecting from moisture, heat, fungus and parasites the lowermost portion of a wood member having a generally rectangular cross-section and supported by an elevated base. The method includes the step of superposing on the member a cap including opposed first and second lateral faces and opposed third and fourth lateral faces orthogonal to the first and second faces. Each contiguous pair of mutually orthogonal faces is rigidly attached along a common edge, and each face has generally parallel top and bottom edges. The cap further includes a top face having four mutually orthogonal, independently flexible web portions. Each web portion has a relatively thick outer edge rigidly attached along the top edge of a lateral face, tapers in thickness from the outer edge to a relatively thin inner edge, and laterally tapers symmetrically inwardly from the outer edge to the inner edge. The web portion inner edges determine a generally rectangular aperture conforming to the cross-section of the wood member. The method further includes the step of closely and slidably receiving the member through the aperture so that each web portion inner edge is in pressing contact with the member when the lateral face bottom edges reach a predetermined above-ground clearance.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENT

Figure 1:
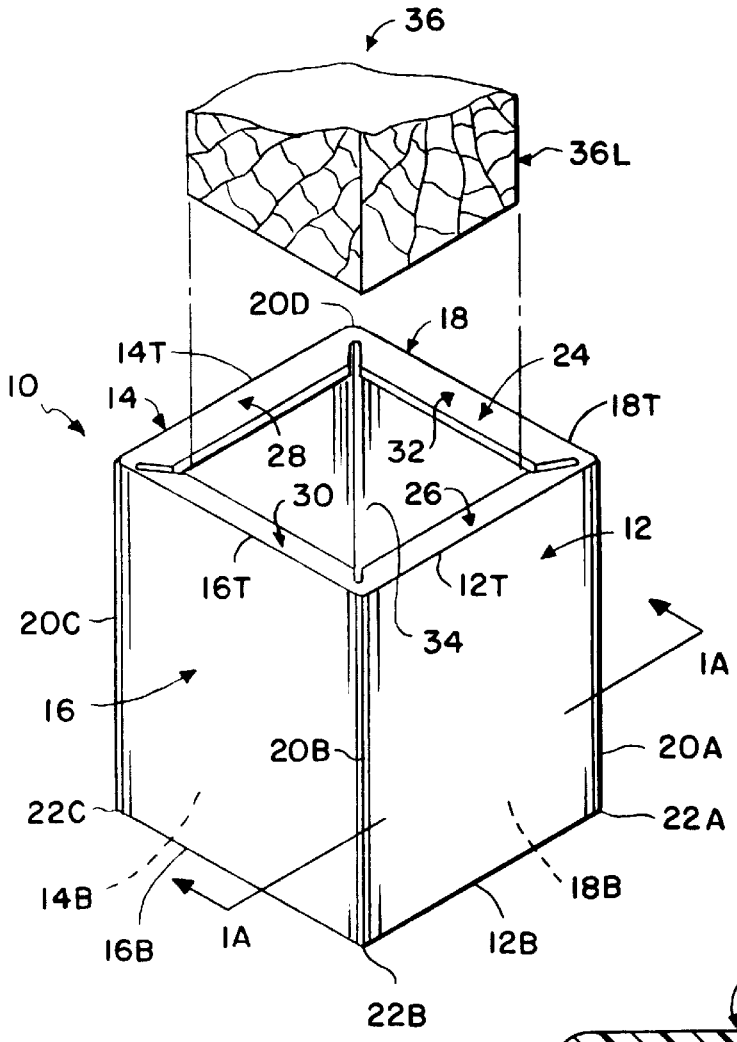
FIG. 1 is an exploded perspective view of a cap having a square aperture bounded by four flexible web portions, and a nominally square cross-section wood column over which the cap is slidable.

While the present invention is open to various modifications and alternative constructions, the preferred embodiment shown in the drawings will be described herein in detail. It is to be understood, however, there is no intention to limit the invention to the particular form disclosed. On the contrary, it is intended that the invention cover all modifications, equivalences and alternative constructions falling within the spirit and scope of the invention as expressed in the appended claims. Nor is there an intention to limit application of the invention to shielding the lowermost portion of wood columns such as are used in housing construction or to limit the cross-section of wood members thus protected to be nominally square. Specifically, the invention is readily adaptable for any wood member having a nominally rectangular cross-section which is supported by an elevated base, such as are used in the construction of decks, porches, garages, car ports, and farm sheds and other such outbuildings. Further, the invention can be adapted for any member having a triangular, quadrilateral or polygonal cross-section, provided there is a base which can accommodate the member.

Where used herein, the term "rigidly attached" means that the parts referred to are monolithically molded in a single piece from a thermoplastic. However, other forms of attachment may be suitable, consistent with simplicity of manufacture and reliability of operation.

Figure 1A:
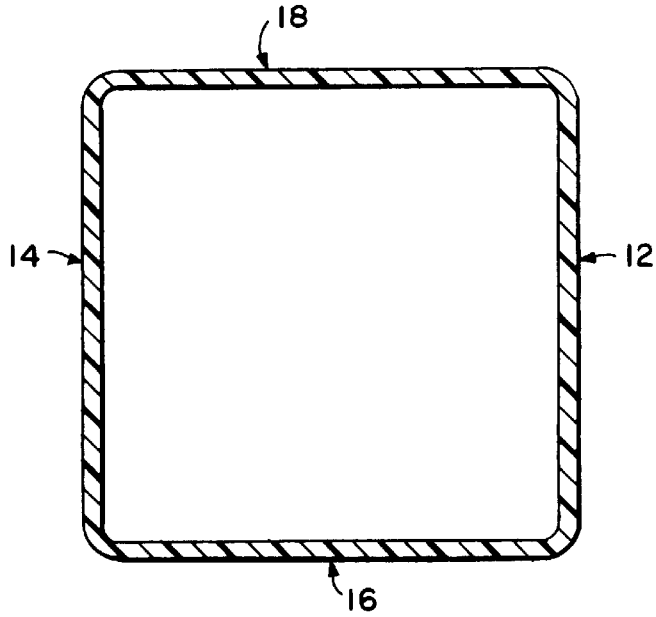
FIG. 1A is a cross-sectional view of the FIG. 1 cap taken along cutting plane 1A—1A.
Figure 2:
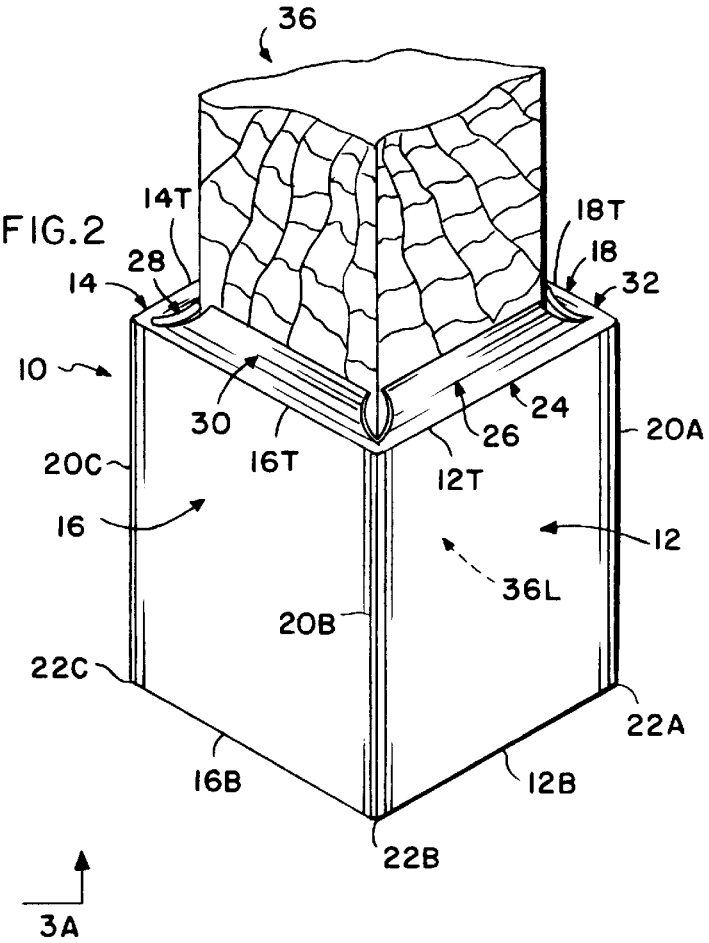
FIG. 2 is a perspective view of the FIG. 1 cap and column.

Referring to FIGS. 1 and 2, a cap 10 according to the invention includes opposed generally planar, generally rectangular first and second lateral faces 12, 14 and opposed generally rectangular third and fourth lateral faces 16, 18 generally orthogonal to faces 12, 14. Each face has a common thickness (see FIG. 1A) and each contiguous pair of mutually orthogonal faces (18, 12), (12, 16), (16, 14), (14, 18) is rigidly attached along a common generally vertical edge 20A, 20B, 20C, 20D, respectively. Faces 18, 12, 16, 14 have generally parallel top and bottom edges (18T, 18B), (12T, 12B), (16T, 16B), (14T, 14B), respectively. Each contiguous pair of bottom edges determine a bottom corner edge, of which three edges 22A, 22B, 22C are visible.

Figure 3:
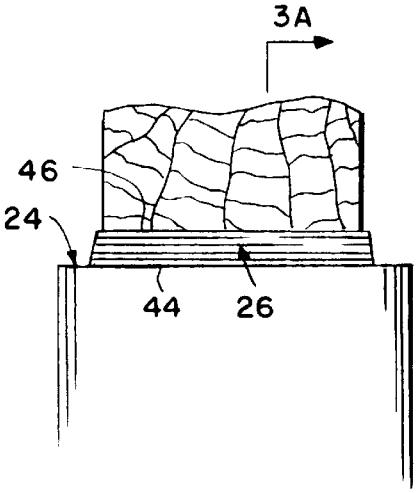
FIG. 3 is a side elevational view of the FIG. 1 cap and column.
Figure 3A:
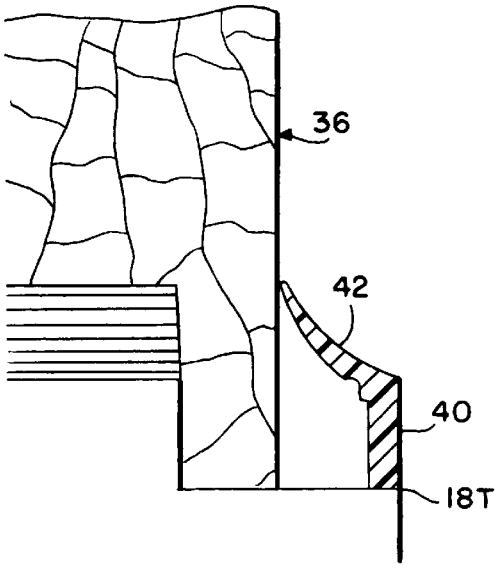
FIG. 3A is a cross-sectional view taken along cutting plane 3A—3A of FIG. 3, showing a FIG. 2 web portion contacting a column face.

Referring to FIGS. 1, 2 and 3, cap 10 further includes a generally square top face 24 having four mutually orthogonal, independently flexible web portions 26, 28, 30, 32. The web portions determine a generally square aperture 34 through which the lowermost portion 36L of a wood column 36 having a generally square cross-section is closely and slidably received. Typically, the column cross-section is nominally 4 inches×4 inches, 6 inches×6 inches, or 8 inches×8 inches. As depicted in FIG. 3A, each web portion tapers from a relatively thick end 40 rigidly attached along the top edge (here, 18T) of a lateral face to a relatively thin end 42 in pressing contact with a face of the wood column. As best seen in FIG. 3, each web portion tapers symmetrically inwardly from an outer edge 44 to an inner edge 46.

For a particular wood member and elevated base combination, the dimensions of faces 12, 14, 16, 18 are selected so that the base is closely received within cap 10 and there is a desired above-ground clearance between bottom edges 12B, 14B, 16B, 18B and the surface of the concrete or earth in which the base is embedded or on which it is mounted.

What is claimed is:

1. A cap comprising:

a plurality of generally planar lateral faces, each contiguous pair of faces rigidly attached along a common edge, each face having generally parallel top and bottom edges; and a top face having a plurality of independently flexible web portions, each web portion having a relatively thick outer edge rigidly attached along the top edge of a lateral face, each web portion tapering in thickness from the outer edge to a relatively thin inner edge, the web portion inner edges determining an aperture.

2. The cap of claim 1, wherein the cap is monolithically molded from a thermoplastic material.

3. A cap comprising:

opposed first and second lateral faces and opposed third and fourth lateral faces orthogonal to the first and second faces, each contiguous pair of mutually orthogonal faces rigidly attached along a common edge, each face having generally parallel top and bottom edges, each contiguous pair of bottom edges determining a bottom corner edge; and a top face having four mutually orthogonal, independently flexible web portions, each web portion having a relatively thick outer edge rigidly attached along the top edge of a lateral face, each web portion tapering in thickness from the outer edge to a relatively thin inner edge, each web portion laterally tapering symmetrically inwardly from the outer edge to the inner edge, the web portion inner edges determining a generally rectangular aperture.

4. The cap of claim 3, wherein the cap is monolithically molded from a thermoplastic material.

5. The cap of claim 3, wherein the rectangular aperture determined by the web portion inner edges is generally square.

6. The cap of claim 5, wherein the aperture is about 4 inches×4 inches.

7. The cap of claim 5, wherein the aperture is about 6 inches×6 inches.

8. The cap of claim 5, wherein the aperture is about 8 inches×8 inches.

9. A method for protecting from moisture, heat, fungus and parasites the lowermost portion of a wood member having a generally rectangular cross-section and supported by an elevated base, comprising the steps of:

superposing on the member a cap comprising opposed first and second lateral faces and opposed third and fourth lateral faces orthogonal to the first and second faces, each contiguous pair of mutually orthogonal faces rigidly attached along a common edge, each face having generally parallel top and bottom edges; the cap further comprising a top face having four mutually orthogonal, independently flexible web portions, each web portion having a relatively thick outer edge rigidly attached along the top edge of a lateral face, each web portion tapering in thickness from the outer edge to a relatively thin inner edge, the web portion inner edges determining a generally rectangular aperture conforming to the cross-section of the wood member; and closely and slidably receiving the wood member through the aperture so that each web portion inner edge is in pressing contact with the member when the lateral face bottom edges reach a predetermined above-ground clearance.

* * * * *

UNITED STATES PATENT AND TRADEMARK OFFICE

CERTIFICATE OF CORRECTION

PATENT NO. : 6,073,416
DATED : June 13, 2000
INVENTOR(S) : Henry Peter Doeringer It is certified that error appears in the above-indentified patent and that said Letters Patent is hereby corrected as shown below:

Title page, item [75], inventor: should be changed to --Henry Peter Doeringer--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*